US011905050B2

(12) United States Patent
Elliott et al.

(10) Patent No.: US 11,905,050 B2
(45) Date of Patent: Feb. 20, 2024

(54) CONTAINER CARRIER APPLICATOR AND METHOD

(71) Applicants: Keith James Elliott, San Marcos, CA (US); Kevin Alan L'Heureux, Santa Clarita, CA (US); Wayne Gebhardt, Cheney, WA (US)

(72) Inventors: Keith James Elliott, San Marcos, CA (US); Kevin Alan L'Heureux, Santa Clarita, CA (US); Wayne Gebhardt, Cheney, WA (US)

(73) Assignee: FISHBONE PACKAGING INC., San Marcos, CA (US)

( * ) Notice: Subject to any disclaimer, the term of this patent is extended or adjusted under 35 U.S.C. 154(b) by 0 days.

(21) Appl. No.: 17/903,760

(22) Filed: Sep. 6, 2022

(65) Prior Publication Data

US 2022/0411114 A1 Dec. 29, 2022

Related U.S. Application Data

(63) Continuation-in-part of application No. 16/950,804, filed on Nov. 17, 2020, now Pat. No. 11,511,895.

(60) Provisional application No. 63/241,061, filed on Sep. 6, 2021, provisional application No. 63/093,856, filed on Oct. 20, 2020, provisional application No. 62/936,744, filed on Nov. 18, 2019.

(51) Int. Cl.
*B65B 17/02* (2006.01)

(52) U.S. Cl.
CPC ..... *B65B 17/025* (2013.01)

(58) Field of Classification Search
USPC ..... 53/398
See application file for complete search history.

(56) References Cited

U.S. PATENT DOCUMENTS 3,708,950 A * 1/1973 Doucette ..... B65B 17/025 53/49
2021/0261279 A1* 8/2021 Zacherle ..... B65B 35/30

* cited by examiner

*Primary Examiner* — Chinyere J Rushing-Tucker
(74) *Attorney, Agent, or Firm* — QuickPatents; Kevin Prince

(57) ABSTRACT

A system for packaging two or more containers with a paperboard carrier having two or more apertures. Each aperture has a plurality of tabs formed at an inside edge thereof that bend upward when contacting a lower edge of a chime of one of the containers. The system includes a platen having apertures for pressing the carrier down uniformly onto the containers and carrier supports configured for maintaining the carrier in a flat configuration as the platen presses the carrier onto the containers substantially simultaneously. Some embodiments of the system include a manual applicator, while other embodiments include a semi-automatic apparatus that utilize linear actuators to facilitate loading the carriers and applying the carriers to a group of containers. Methods of use are also disclosed.

35 Claims, 13 Drawing Sheets

CONTAINER CARRIER APPLICATOR AND METHOD

CROSS-REFERENCE TO RELATED APPLICATIONS

This application claims the benefit of U.S. Provisional Patent Application 63/241,061 filed on Sep. 6, 2021, and is further a Continuation-in-Part of U.S. Utility patent application Ser. No. 16/950,804, filed on Nov. 17, 2020, which itself claimed the benefit of U.S. Provisional Patent Applications 62/936,744 filed on Nov. 19, 2019 and 63/093,856 filed on Oct. 20, 2020, all incorporated herein by reference.

STATEMENT REGARDING FEDERALLY SPONSORED RESEARCH AND DEVELOPMENT

Not Applicable.

FIELD OF THE INVENTION

This invention relates to packaging, and more particularly to packaging of beverage or food containers.

BACKGROUND

The term "carrier" as used herein refers to any carrying means that, in combination with a container, allows for the transport of the container.

The term "container" as used herein, refers to any container that includes a neck or chime portion on the container that is adapted for receiving a carrier having a container-engaging opening. The container may hold a liquid, for example, a beverage, or a non-beverage such as snacks. The container may also be referred to herein as a vessel canister, can, jar, bottle, or other sealed receptacles. Common containers are made with metal, glass, plastic, molded pulp, aluminum, or paper, or the like The term "tab" refers to protruding areas inside apertures of the carrier that once bent upwardly connect with the chime of the container to temporarily couple the carrier with the container until it is forcibly removed.

The term "neck" refers to a collar on a can, bottle or other container type. The portion of the collar or chime that is closest to the neck of the container defines a ledge, the lower side of the chime, that is supported by the carrier.

The term chime is the area of the container that is turned in on itself to provide a safe finished curved edge, flange, or hem at the top or lid of the container. The chime provides the ledge that is supported by the carrier.

There are many types of multi-packing carriers in the beverage and non-beverage container industry. The beverage and non-beverage carriers are often circular plastic ring carriers, commonly known as six pack rings, which package together a plurality of like sized containers into a single article that is easier to carry than the individual containers. Some circular plastic rings or "multi-packaging rings" are injected molded or extruded, but are more commonly fabricated from flat, thin gauge sheets of plastic. Circular plastic ring carrying devices such as the low-density polyethylene (LDPE), high density polyethylene (HDPE) and other circular plastic type carriers are common in the market, and yet they are loathed by manufacturers and consumers alike. Such plastic ring carriers are available in a variety of configurations, dimensions and shapes such as square, circular, triangular and other shapes. There are other types of multi-packaging systems to carry beverages and non-beverages containers. Some examples are paper cartons, corrugated containers, boxes, wax boxes, folding cartons, beverage baskets, molded pulp, plastic or other like materials.

Circular plastic rings and multi-packaging carriers that package a plurality of containers by their necks or chimes and allow the containers to be carried are well known. These circular plastic rings and multi-packaging carriers are commonly used to secure cans or containers through the manufacturing, supply, inventory, distribution, retail and consumer use chain. The most common use of these circular plastic ring carriers and multi-packaging carriers are in supermarkets, convenience stores, the food delivery industry, and other retail locations.

Such common circular plastic ring multi-packaging systems often secure containers of soda, beer, juice, water, energy drinks and other liquids and are typically manufactured for a variety of containers and various plural configurations such as two, four, six, eight, etc., for in-line configurations such as two rows, three rows, etc. The low-density polyethylene (LDPE) carrying devices and the high-density polyethylene (HDPE) carrying devices currently being manufactured are an inherent danger to the environment and a frustration point to both manufactures and customers. These circular plastic ring multi-packaging systems clog waterways and landfills once discarded. Wildlife animals are often severely injured or killed due to entrapment or ingestion of such circular plastic rings.

Furthermore, the plastic material utilized to manufacture such devices breaks down over time in a variety of processes including photo-degradation and transforms into microscopic pieces commonly referred to as micro-plastics. These plastics derivatives pollute landfills, ocean eco-systems and are commonly ingested by land animals, birds, ocean and sea life as small as phytoplankton thus eventually making their way back through our food supply chain as well as into our drinking water with ill health effects in humans having been observed. Such traditional circular plastic ring beverage carrying devices may become malformed and lose elasticity when exposed to light due to photo-degradation (UV exposure), or due to heat and other factors, often causing containers to dislodge from the caring device, causing product damage or loss. Such circular plastic rings have resulted in major environmental concerns, and this type of packaging is becoming less desirable or outright banned from the marketplace by some jurisdictions.

Manufacturers, retailers, and consumers are looking for multi-packaging carrier solutions that leave a smaller carbon footprint. Using less material, or using materials that are biodegradable or recyclable, results in less damage to the environment and would be preferable. This has caused retail businesses and manufacturers to look for alternative biodegradable, recyclable, and low material use packaging solutions for carrying beverage and non-beverage containers. There is a need for an apparatus and method for efficiently and accurately applying such a biodegradable, recyclable carrier that uses less material for carriers for containers. Such a needed invention would facilitate manually applying such a carrier to a plurality of cans, or offer a semi-automated process for doing the same. The present invention accomplishes these objectives.

SUMMARY OF THE INVENTION

The present device is a system for packaging two or more containers of the type having a body, a neck, and a lid with a chime with a lower edge. When the chimes of the containers are all aligned in a horizontal plane, the containers can be packaged together with a carrier of the type having two or more apertures, each aperture for receiving the chime and neck of one of the containers. Each aperture has a plurality of tabs formed at an inside edge of the aperture. Each tab is configured for bending upward when contacting the lower edge of the chime of one of the containers.

Preferably each tab is formed in a generally trapezoidal shape with gaps being defined therebetween, which maintains desired strength during use and results in the containers being firmly held within the carrier during normal transport and handling. To remove a container from the carrier, the container and carrier may be manually, forcefully separated, or the carrier may be manually torn.

The number of apertures in the carrier determines the number of containers that are packaged together thereby. The carrier is preferably a paper-based material that is semi-resilient, easily die-stamped, biodegradable, recyclable, and that can permanently receive printed indicia thereon. The carrier may be any suitable shape, such as rectangular with four corners for holding six containers, square for holding four containers, triangular for holding ten containers in a triangular pattern, for example, and so forth. Any suitable shape, even irregular shapes, of carriers may be used.

The carrier of the present invention uses less material than prior art carton solutions, and further displays more of the container body. Showing more of the container body allows a larger viewing area for brand graphics on the container. This is both a benefit to the consumer and to the manufacturer, providing the consumer a better understanding of the benefits and the use of the product packaged within the container.

An application tool includes a top side, a bottom side that forms a platen that has apertures for pressing the carrier down uniformly onto the containers. Each aperture has a gap between an inside aperture wall and the chime of one of the containers. The application tool has at least three side walls that project downwardly from the bottom side to form a skirt that is open at a bottom end thereof, the open end for receiving first the carrier and then the containers therethrough.

At least three carrier supports are fixed at corners of the platen. Each carrier support is movable between an extended position and a retracted position. The carrier support includes a shelf configured to contact at least a portion of a bottom side of the carrier to maintain the carrier in a flat configuration when the carrier supports are in their extended positions. When retracted, the shelf retracts away from the carrier. A spring urges the carrier support towards the extended position. Preferably each carrier support includes a pivot pin, such that the carrier supports pivot between the extended position and the retracted position.

As such, in use, with the carrier inserted into the application tool to retract all of the carrier supports, the carrier is then supported by all of the carrier supports when the carrier supports spring back into their extended positions. The containers are all positioned in accordance to a pattern of the apertures in the carrier below the platen and the carrier. The application tool and platen are then lowered until the tabs of the carrier deform upwardly substantially simultaneously to pass the chimes of the containers. Each tab abuts a lower edge of the chime of one of the containers in order to hold the containers together with the carrier. The platen thereafter is withdrawn from the carrier and the containers to release the carrier and containers from the application tool.

In some embodiments that feature a semi-automated system, a framework is included for mounting thereon a base surface below a vertical actuator, which may include one or more linear actuators. The vertical actuator has a trolley that moves from a raised position to a lowered position. The trolley includes a rotational actuator that holds the application tool in either a horizontal position wherein the platen is substantially orthogonal to the base surface, or a vertical position wherein the platen of the application tool is substantially parallel with the base surface. As such the application tool is able to be moved between both the raised position and the horizontal position to facilitate loading of the carrier into the application tool, to both the lowered position and the vertical position for applying the carrier to the containers. The base surface may further include at least one guide for placing the containers directly below the application tool where needed based on the pattern of apertures in the carrier.

The use of the present invention allows for the use of recyclable, biodegradable materials to be successfully utilized in multipack container packaging systems in a secure and functional format not previously available. The present system facilitates either manual application of such a carrier to a plurality of cans, or semi-automated application. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
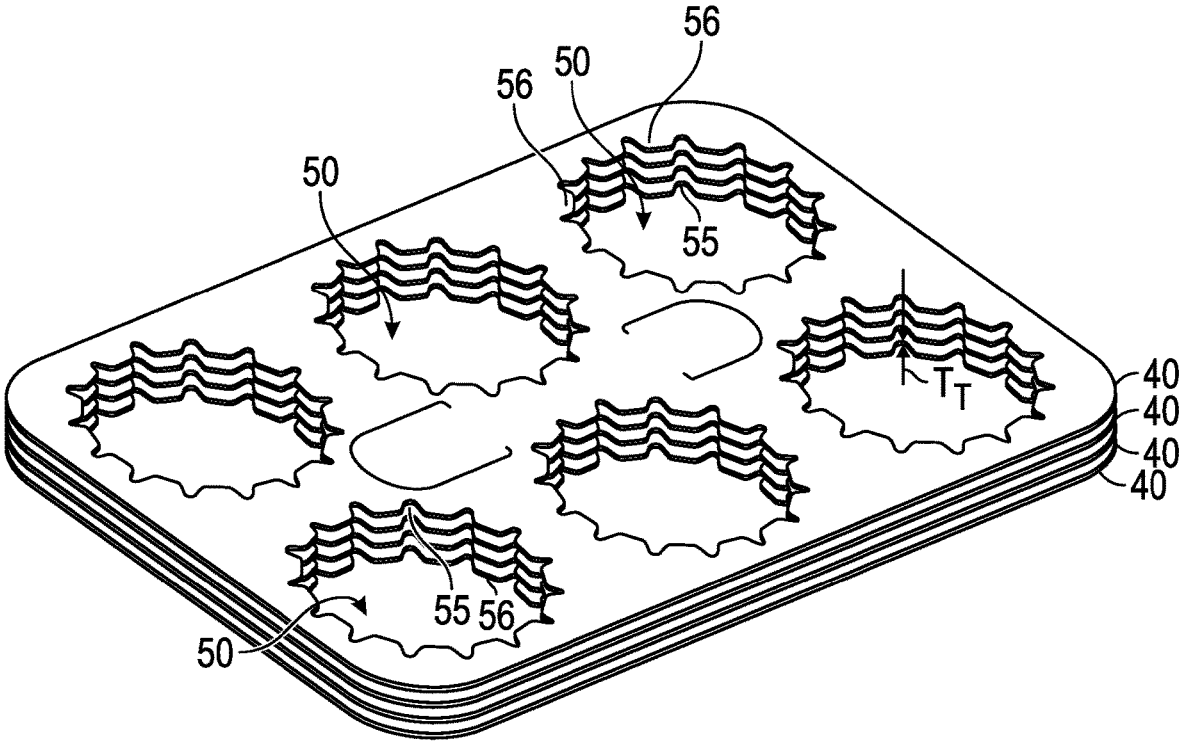
FIG. 1 is a perspective view of a stack of carriers of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1, 2A, 6-10 illustrate a system 10 for packaging two or more containers 20 of the type having a body 25, a neck 26, and a lid 28 with a chime 27 with a lower edge 29. When the chimes 27 of the containers 20 are all aligned in a horizontal plane 30 (FIGS. 5A), the containers 20 can be packaged together with a carrier 40 of the type having two or more apertures 50, each aperture 50 for receiving the chime 27 and neck 26 of one of the containers 20. Each aperture 50 has a plurality of tabs 56 formed at an inside edge 55 of the aperture 50. Each tab 56 has a length $L_T$ and a thickness $T_T$, and is configured for bending upward when contacting the lower edge 29 of the chime 27 of one of the containers 20 (FIGS. 4A-5B). Preferably a ratio of the thickness $T_T$ of each tab to the length $L_T$ of each tab is between 0.448 and 0.100, and ideally at 0.274, so that each tab 56 is sufficiently resilient and does not crease or deform under pressures normally applied by the system 10 and by transporting of the packaged containers 20.

Preferably each tab 56 is formed in a generally trapezoidal shape (FIG. 4A) with gaps 43 being defined therebetween. Other shapes of the tabs 56, such as parallelograms (FIG. 4B) may be utilized, but it has been found that the trapezoidal shaped tabs 56 maintain desired strength during use, which results in the containers 20 being held within the carrier 40 during normal transport and handling. To remove a container from the carrier 40, the container 20 and carrier 40 may be manually, forcefully separated, or the carrier 40 may be manually torn.

Figure 3:
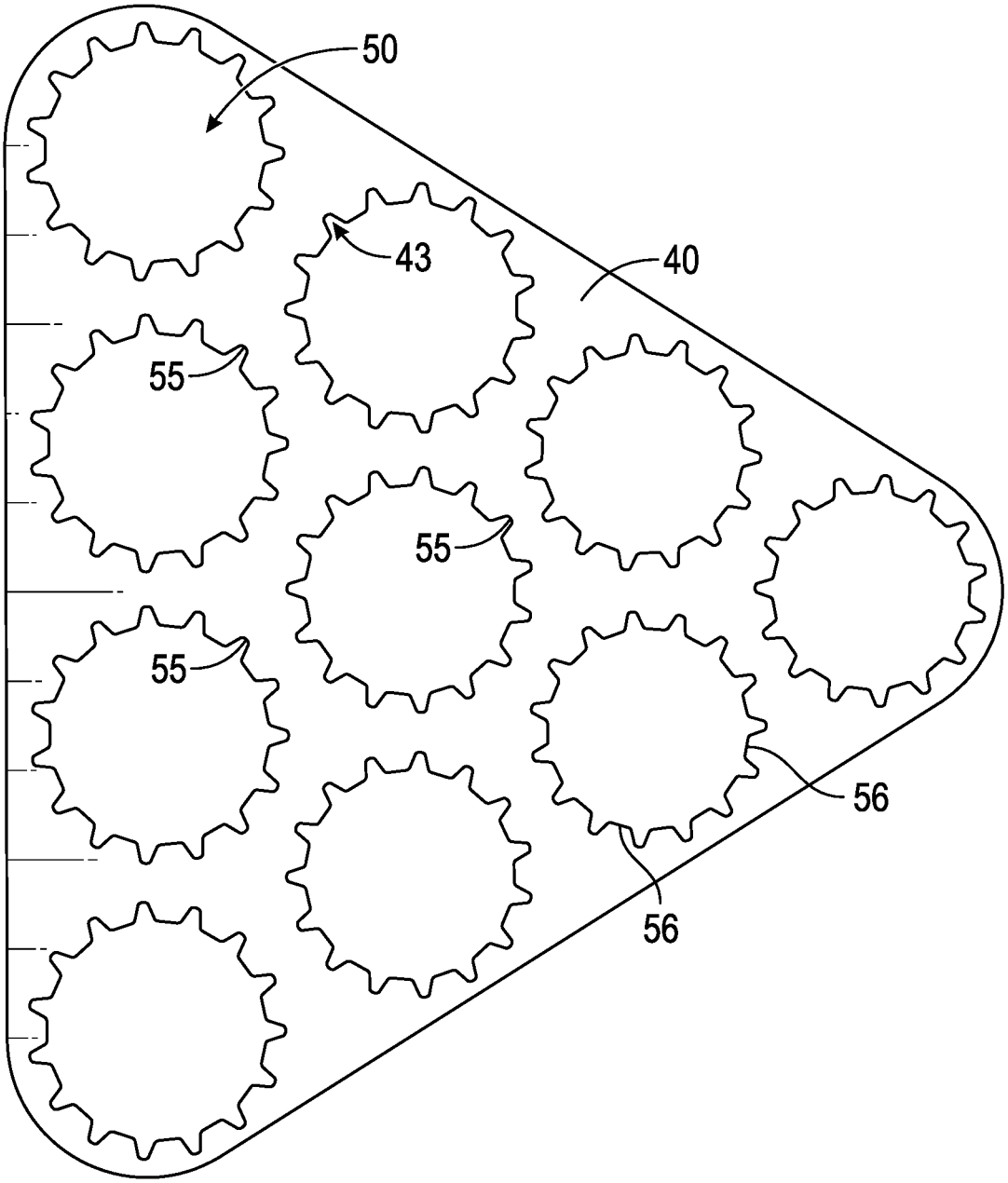
FIG. 3 is an alternate embodiment having a triangular-shaped carrier.
Figure 4A:
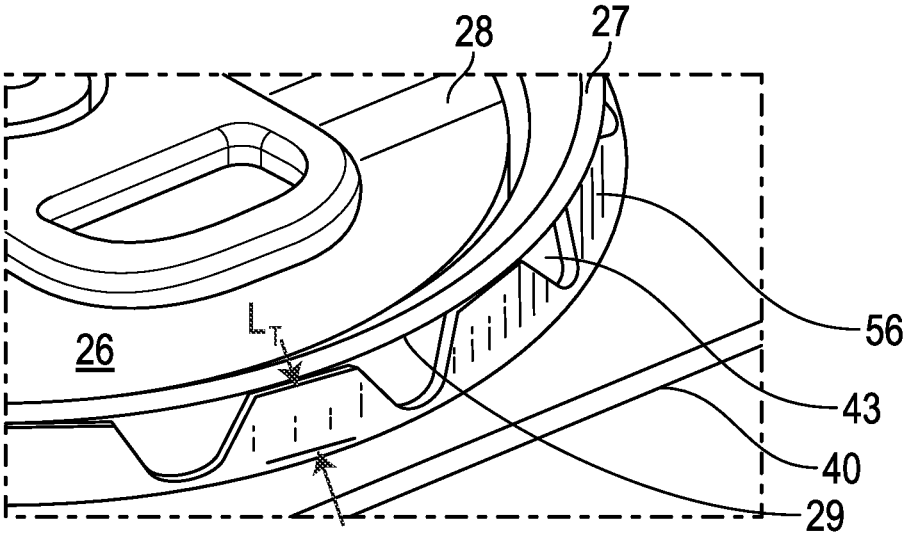
FIG. 4A is an enlarged, partial perspective view of a carrier having upwardly-bent tabs contacting a chime of one of the containers.
Figure 4B:
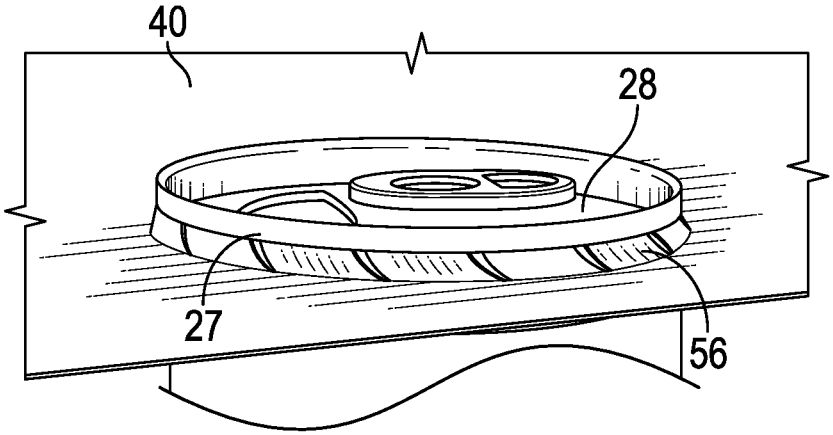
FIG. 4B is an enlarged, partial perspective view of a carrier having alternate tabs.
Figure 5A:
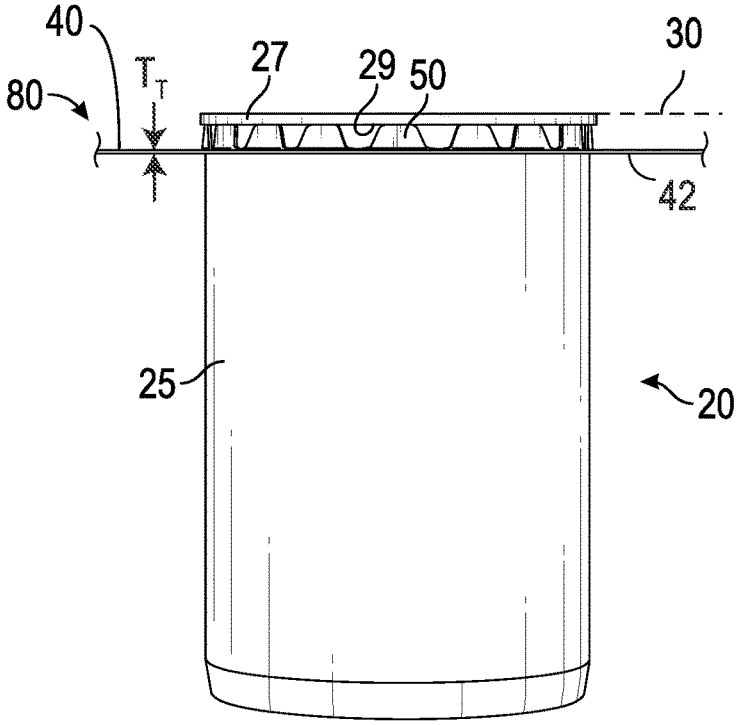
FIG. 5A is a partial side elevational view of a container showing the tabs of the carrier contacting the chime of the container rim.
Figure 5B:
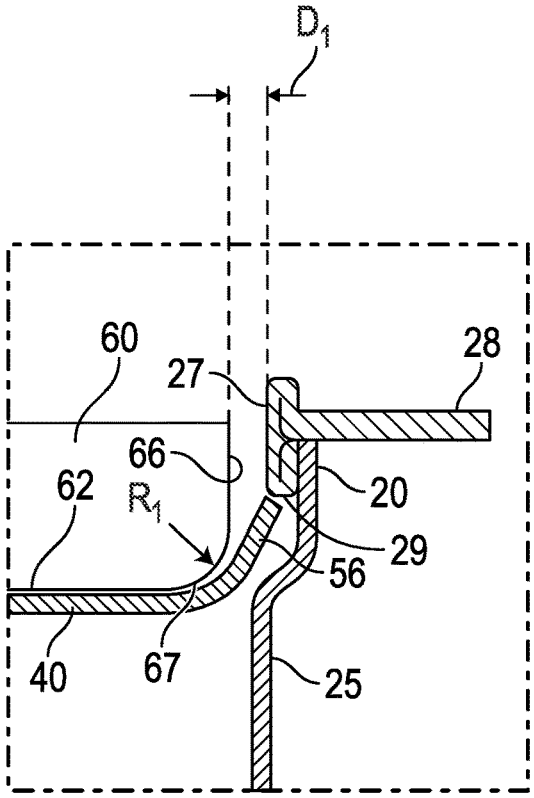
FIG. 5B is an enlarged, partial side elevational view of a platen pressing the carrier down over one of the containers, illustrating a gap between the platen and the container and a radius of a lower corner of the platen.
Figure 6:
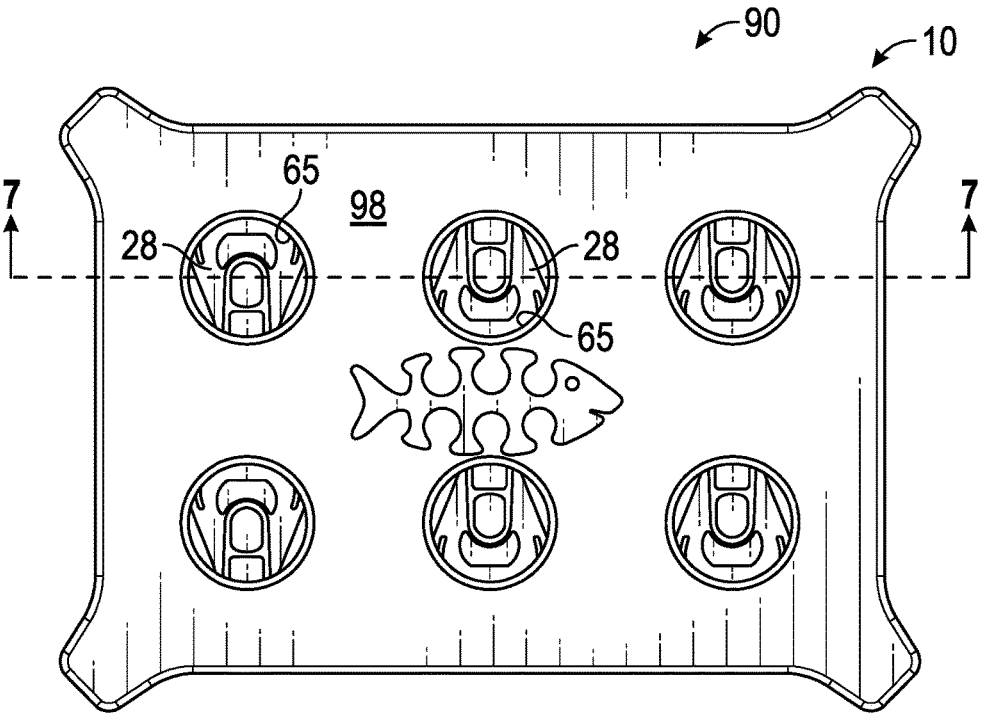
FIG. 6 is a top plan view of an application tool of the present invention.
Figure 7:
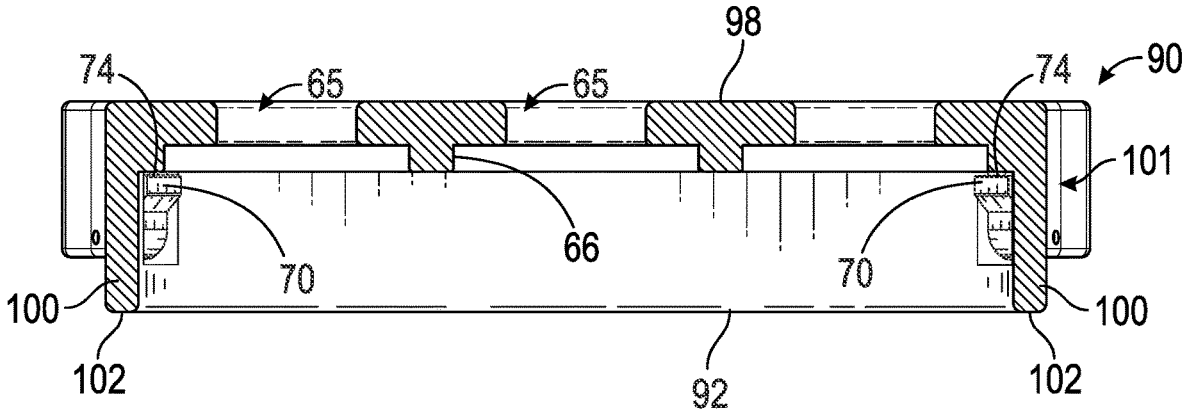
FIG. 7 is a cross-sectional view, taken along line 7-7 of FIG. 6, but with the containers omitted for clarity of illustration.
Figure 8:
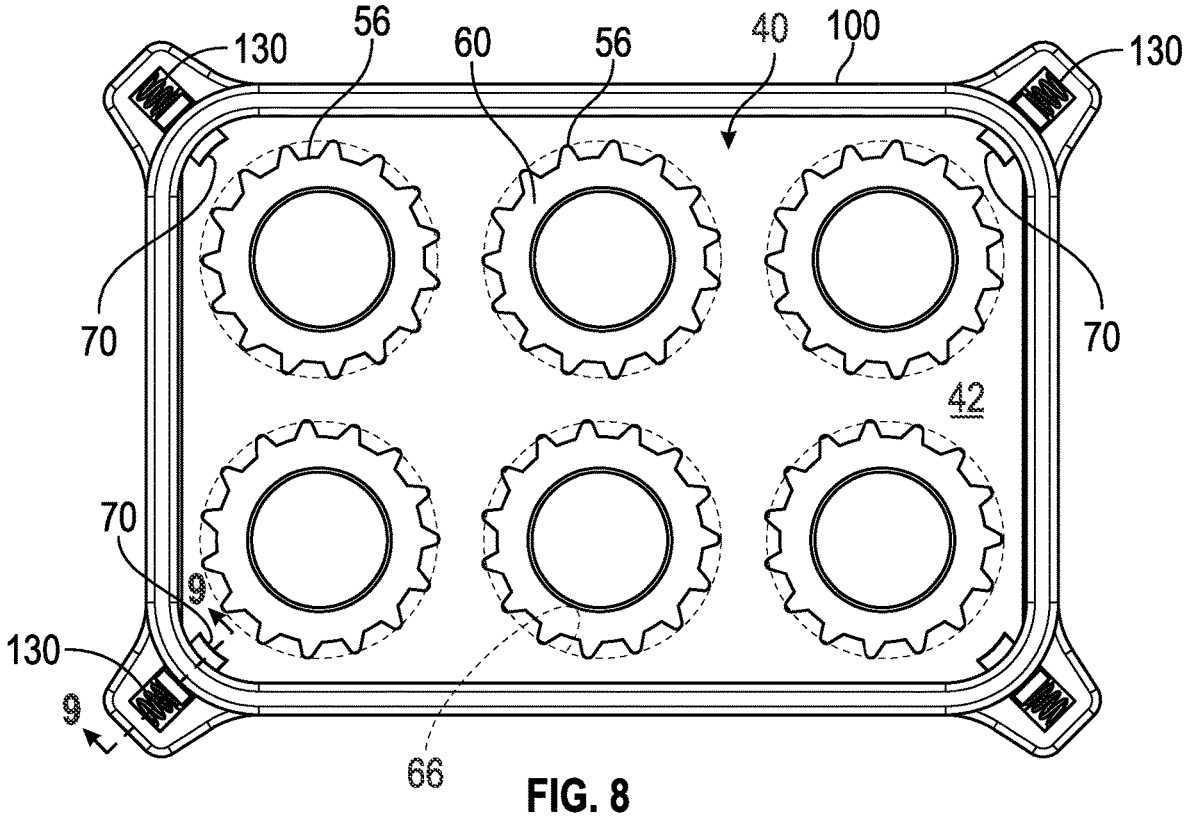
FIG. 8 is a bottom plan view of the application tool of FIG. 6, further including one of the carriers loaded therein.

In some embodiments the system 10 includes the carrier 40, while in other embodiments the system 10 utilizes carriers 40 that are sold separately. Either way, the number of apertures 50 in the carrier 40 determines the number of containers 20 that are packaged together thereby. The carrier 40 is preferably a paper-based material that is semi-resilient, easily die-stamped, biodegradable, recyclable, and that can permanently receive printed indicia thereon. The carrier 40 is preferably die-cut, die-stamped, laser cut, or otherwise formed as is or becomes known in the art. In some embodiments the carrier 40 may include finger cut-outs 41 (FIG. 2A) for facilitating carrying of the carrier 40 and containers 20 with a person's thumb and finger (not shown). The carrier 40 may be any suitable shape, such as rectangular with four corners 45 for holding six containers 20 (FIGS. 1 and 2A), for example, in two rows of three containers 20 each, square for holding four containers 20, for example, in two rows of two containers each (not shown), triangular (FIG. 3) for holding ten containers in a triangular pattern, for example, and so forth. Any suitable shape, even irregular shapes, of carriers 40 may be used.

The carrier 40 of the present invention uses less material than prior art carton solutions, and further displays more of the container body 25. Showing more of the container body 25 allows a larger viewing area for brand graphics (not shown) on the container 20. This is both a benefit to the consumer and to the manufacturer, providing the consumer a better understanding of the benefits and the use of the product packaged within the container 20.

The carrier 40 is preferably manufactured from a kraft carrier board with a wet-strength coating to allow for more rigid material qualities at relatively reduced thickness $T_T$ (FIG. 5A), which helps increase strength of the carrier 40, though the material tends to be costlier than other common kraft board materials available in the market. Such a material preferably has a thickness $T_T$ ranging from a minimum or 0.018 inches+/−5%. to a maximum of 0.030 inches+/−5%. Such a material is preferably made of long-fibrous pulp strands comprising 100% virgin fiber with a clay topcoat.

Such board materials allow an expanded variety of further reduced board thickness $T_T$, to be utilized for the manufacture of product which is able to carry a higher weight per square inch compared to traditionally manufactured wet-strength board material, as well as a highly reduced carbon footprint comparatively. Such a board material is preferably made of a high concentration of virgin fiber inclusive of hardwood materials and utilizes a reduced amount of bonding agents in its construction, increasing recyclability. Such a material preferably has a minimum weight of about 330 g/m2+/−5% with a minimum thickness $T_T$ of about 510 microns+/−5% to a maximum weight of about 460 g/m2+/−5% with a maximum thickness $T_T$ of about 745 microns+/−5%. Such a substrate material provides an increase bending resistance of between 805 to 1850 MD mN, L&W at 15o and an increased tearing resistance of between 7,200 and 12,000 GM mN.

Coatings are preferably added as part of a paper board manufacturing/converting process in order to add moisture resistance on either side of the material. Such coatings may be made from various base substances such as an aqueous (water based coating), bio-based coating, UV coatings, petroleum based coating, clay including but not limited to China clay, calcium carbonate, titanium dioxide or a variety of commercially available and future coating materials. For example, some preferred embodiments including a VpCI-144 coating having a WTR (g/hour*m2) of 0.61-0.69.

Figure 12B:
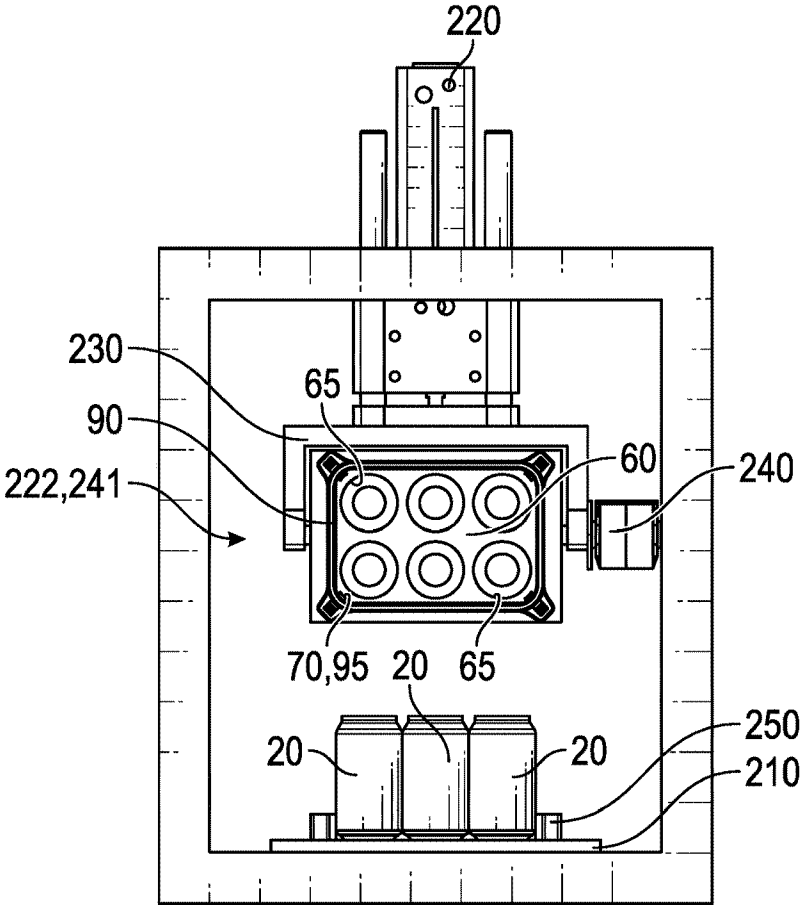
FIG. 12B is a front elevational view of FIG. 12A.

An application tool 90 (FIGS. 6-10) includes a top side 98, a bottom side 92 that forms a platen 60 that has apertures 65 (FIG. 12B) for pressing the carrier 40 down uniformly onto the containers 20. Each aperture 65 has a gap D1 between an inside aperture wall 66 (FIG. 5B) and the chime 27 of one of the containers 20. Preferably the gap D1 is between 0.030 inches and 0.050 inches. The application tool 90 has at least three side walls 100 that project downwardly from the bottom side 92 to form a skirt 101 that is open at a bottom end 102 thereof, the open end for receiving first the carrier 40 and then the containers 20 therethrough.

A corner 67 (FIG. 5B) between a bottom surface 62 of the platen 60 and the inside aperture wall 66 of each aperture 60 of the platen 60 includes a radius $R_1$, preferably between 0.03125 inches and 0.09375 inches, and ideally at 0.0625 inches, that allows the tabs 56 of each aperture 50 of the carrier 40 to bend uniformly and predictably upward as the platen 60 pushes the carrier 40 downwardly onto the containers 20.

Figure 2A:
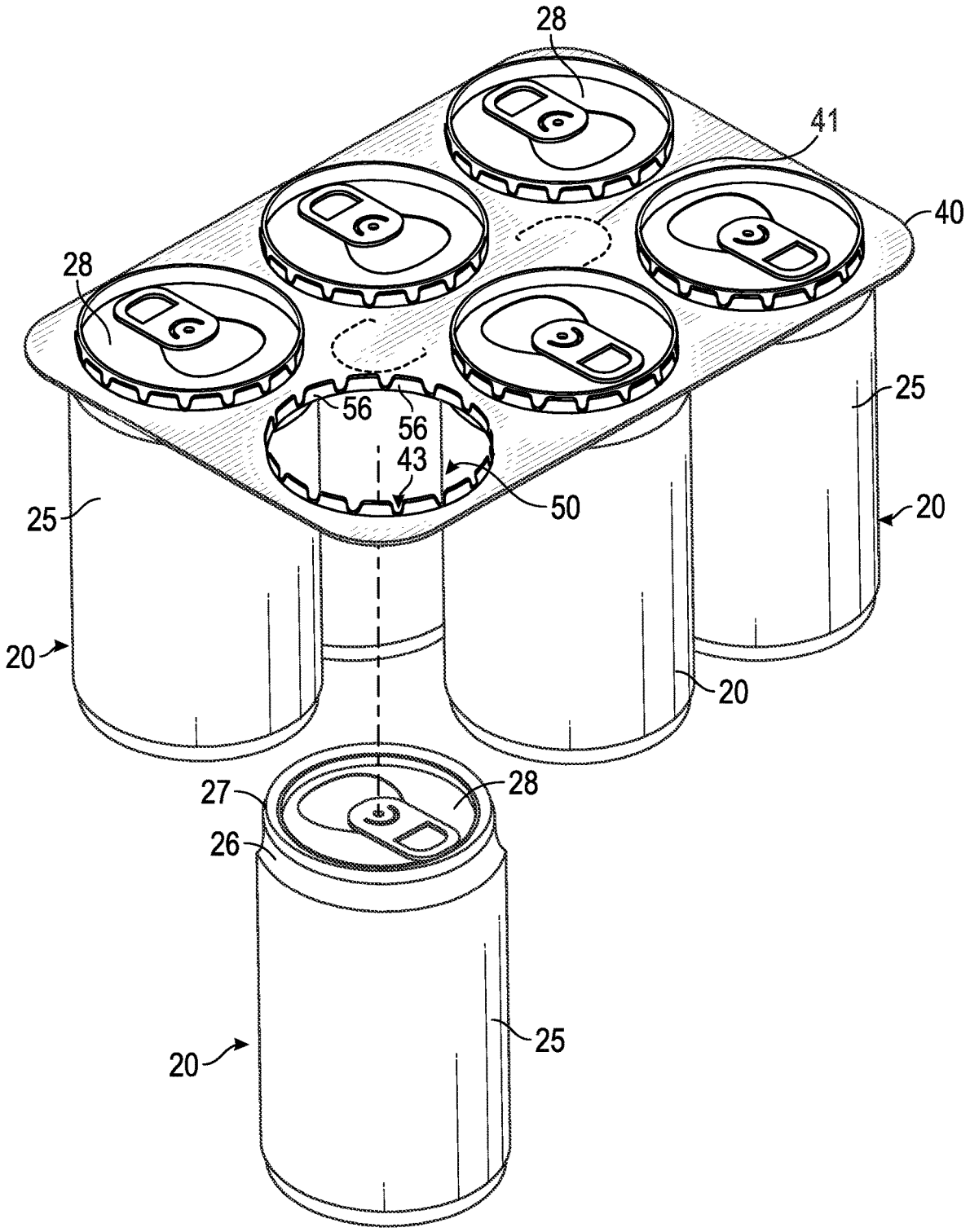
FIG. 2A is a perspective view of a carrier as applied to a plurality of containers.
Figure 2B:
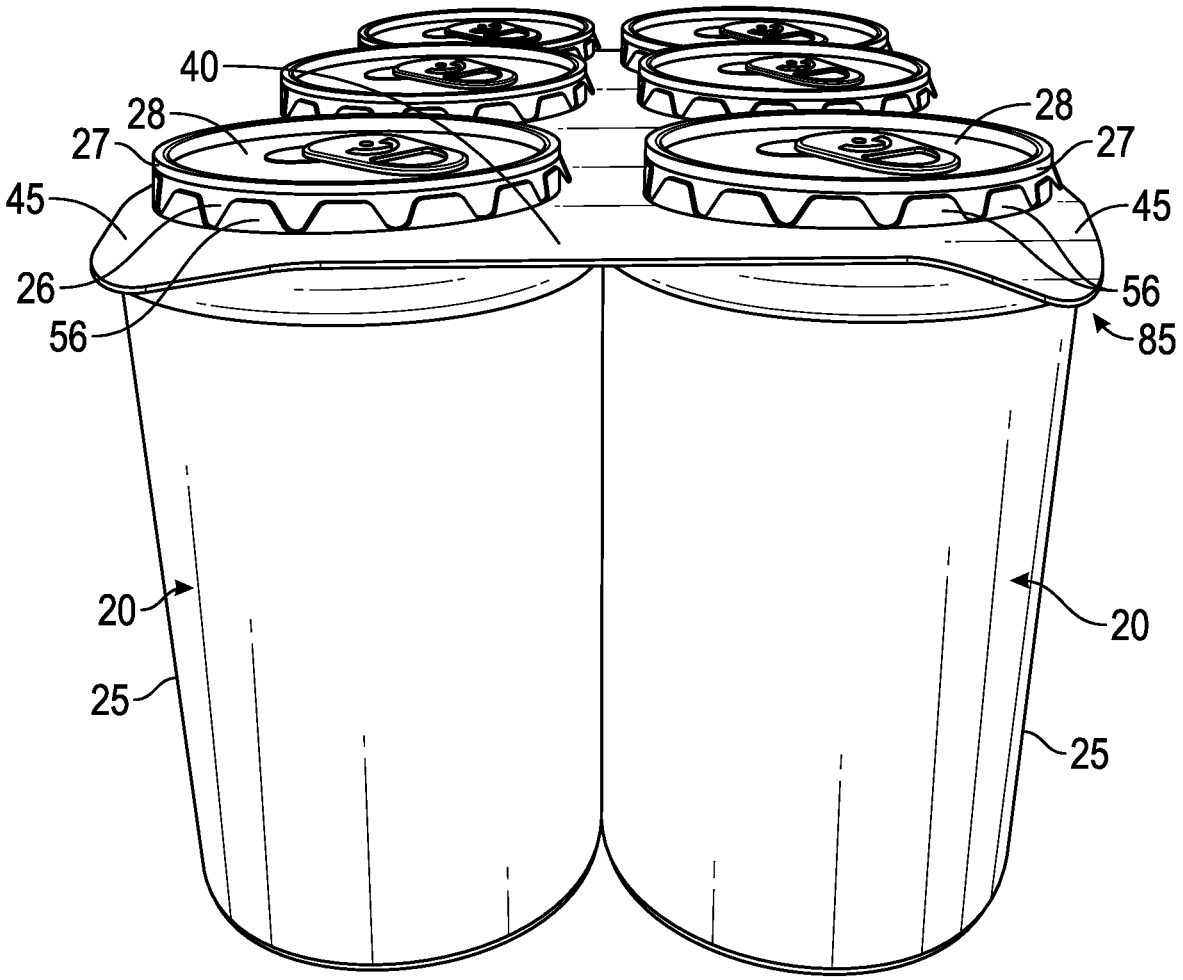
FIG. 2B is an end perspective view of a carrier misapplied to the containers.
Figure 10:
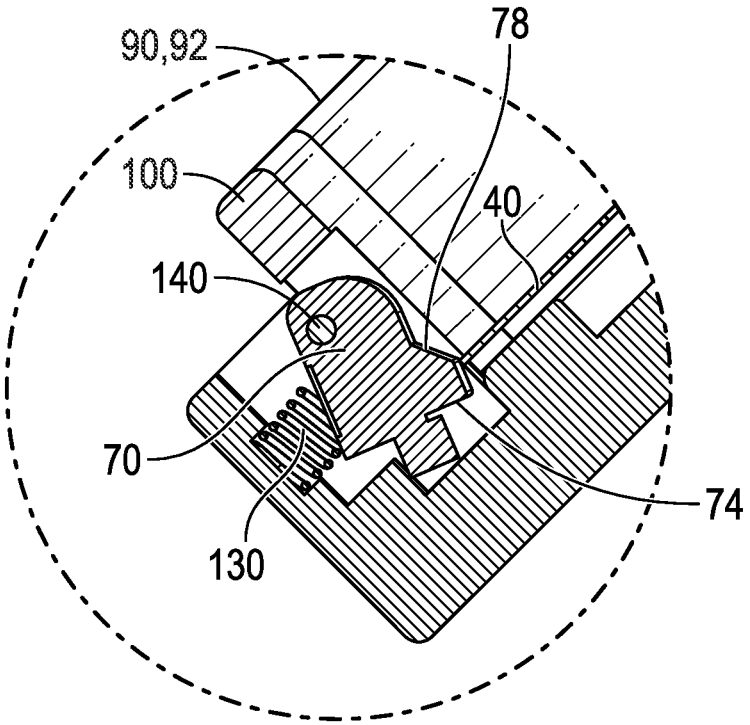
FIG. 10 is a partial cross-sectional view, taken along line 9-9 of FIG. 8 but showing the carrier support in a retracted position.
Figure 11A:
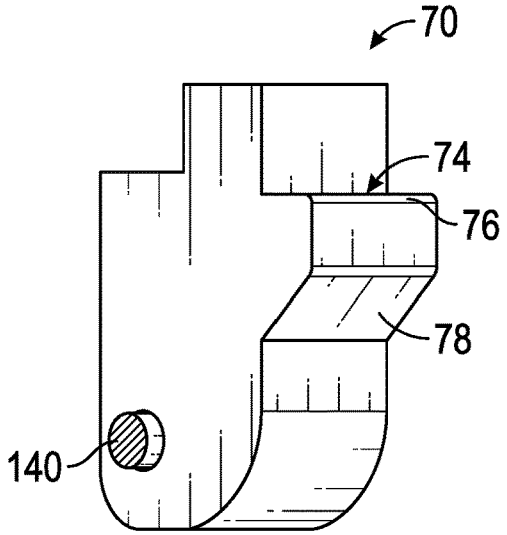
FIG. 11A is an enlarged perspective view of the carrier support.
Figure 11B:
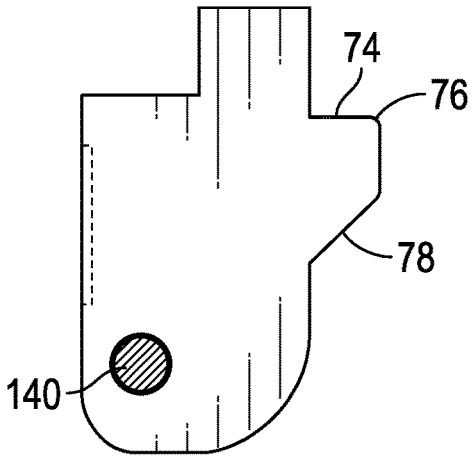
FIG. 11B is a side elevational view of the carrier support.
Figure 11C:
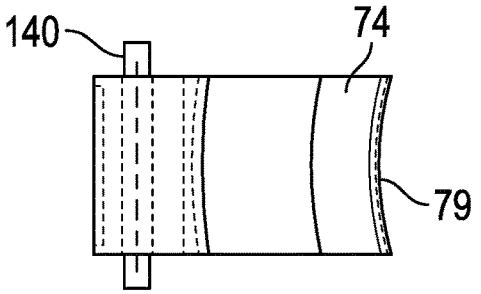
FIG. 11C is a top plan view of the carrier support.

At least three carrier supports 70 (FIGS. 9-11C) are fixed at corners 95 of the platen 60. Each carrier support 70 is movable between an extended position 120 (FIG. 9) and a retracted position (FIG. 10). The carrier support 70 includes a shelf 74 configured to contact at least a portion of a bottom side 42 of the carrier 40 (FIG. 5A) to maintain the carrier 40 in a flat configuration 80 (FIG. 2A), when the carrier supports 70 are in their extended positions 120. When retracted, the shelf 74 retracts away from the carrier 40. A spring 130 urges the carrier support 70 towards the extended position 120. Preferably each carrier support 70 includes a pivot pin 140 (FIGS. 11A, 11B), such that the carrier supports 70 pivot between the extended position 120 (FIG. 9) and the retracted position 110 (FIG. 10). Such an arrangement helps avoid the carrier 40 being in a non-flat configuration 85 (FIG. 2B) when the carrier 40 is applied to the containers 20, which results in inconsistent tab 56 contact with the chimes 27 and failure of the carrier 40 to properly hold the containers 20 during transportation and storage.

Preferably a corner 76 of the shelf 74 of each carrier support 70 is rounded (FIGS. 9-11B). Similarly, a top side 78 of the shelf 74 of each carrier support 70 is tapered or curved, such that when inserting a carrier 40 onto the platen 60, each carrier support 70 is pressed by the carrier into the retracted positions 110 until the carrier 40 passes the shelf 74. Thereafter each carrier support 70 moves back to the extended position 120 to capture the carrier 40 against the platen 60. In some embodiments the shelf 74 has a curved face 79 (FIG. 11C) to conform to the shape of the corners 45 of the carrier 40.

Figure 9:
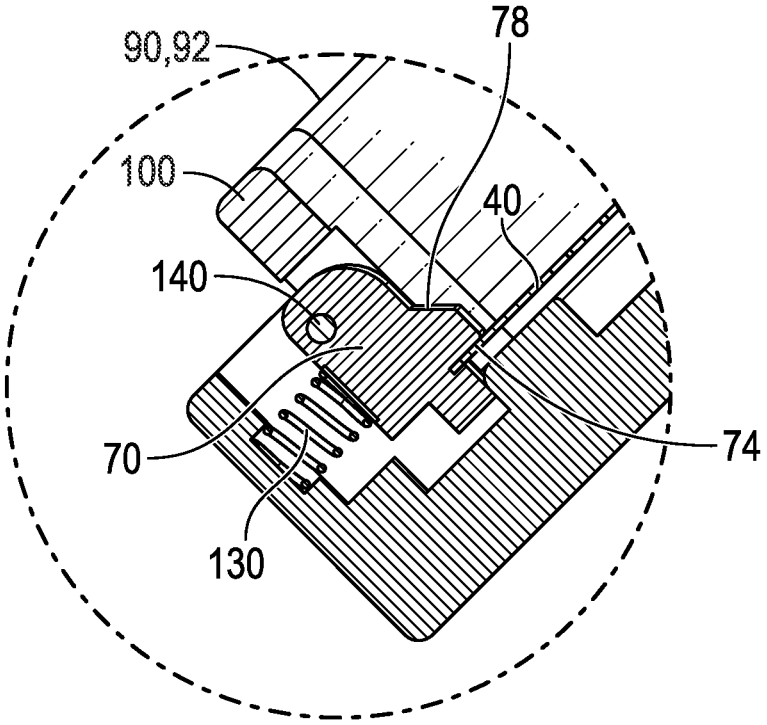
FIG. 9 is a partial cross-sectional view, taken along line 9-9 of FIG. 8, showing a carrier support in an extended position.

As such, in use, with the carrier 40 inserted into the application tool 90 to retract all of the carrier supports 70, the carrier 40 is then supported by all of the carrier supports 70 when the carrier supports spring back into their extended positions 120 (FIG. 9). The containers 20 are all positioned in accordance to a pattern of the apertures 50 in the carrier 40 below the platen 60 and the carrier 40. The application tool 90 and platen 60 are then lowered until the tabs 56 of the carrier 40 deform upwardly substantially simultaneously to pass the chimes 27 of the containers 20. Each tab 56 abuts a lower edge 29 of the chime 27 of one of the containers 20 in order to hold the containers 20 together with the carrier 40. The platen 60 thereafter is withdrawn from the carrier 40 and the containers 20 to release the carrier 40 and containers 20 from the application tool 90.

Figure 12A:
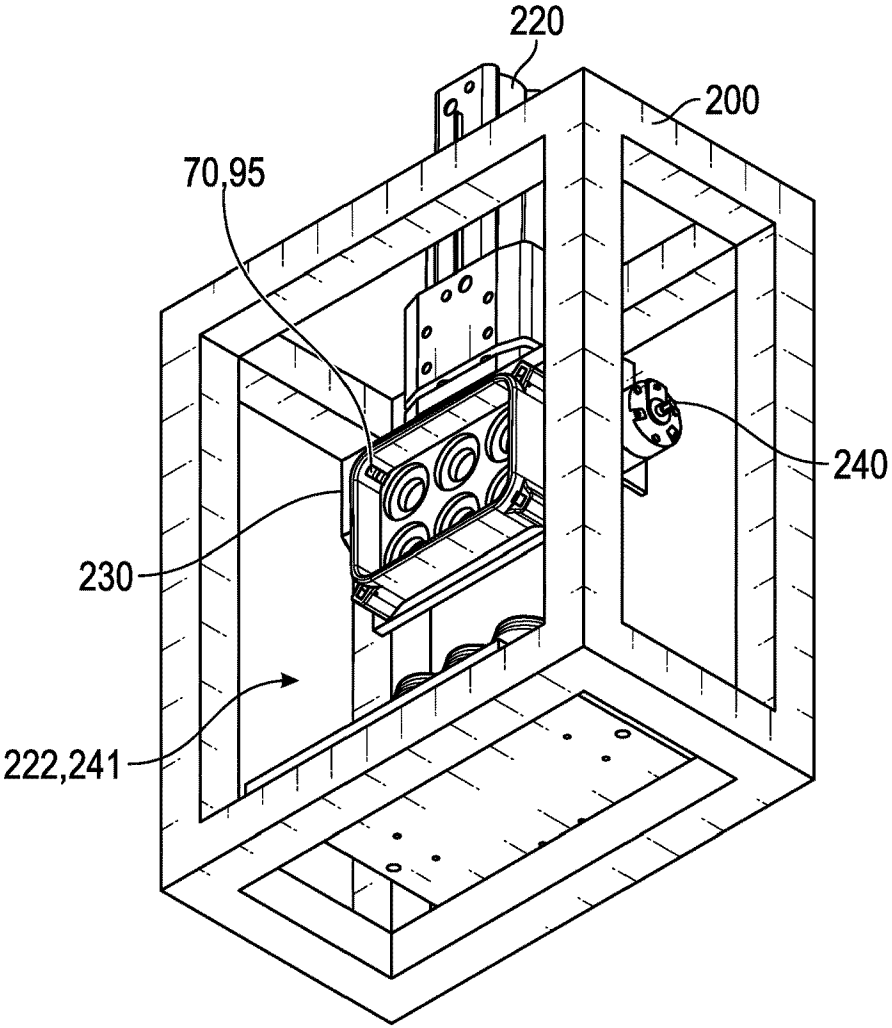
FIG. 12A is a bottom perspective view of a semi-automated machine for pressing the carrier onto a group of the containers utilizing a vertical actuator and a rotational actuator, illustrated with the application tool in a horizontal and raised position.
Figure 13B:
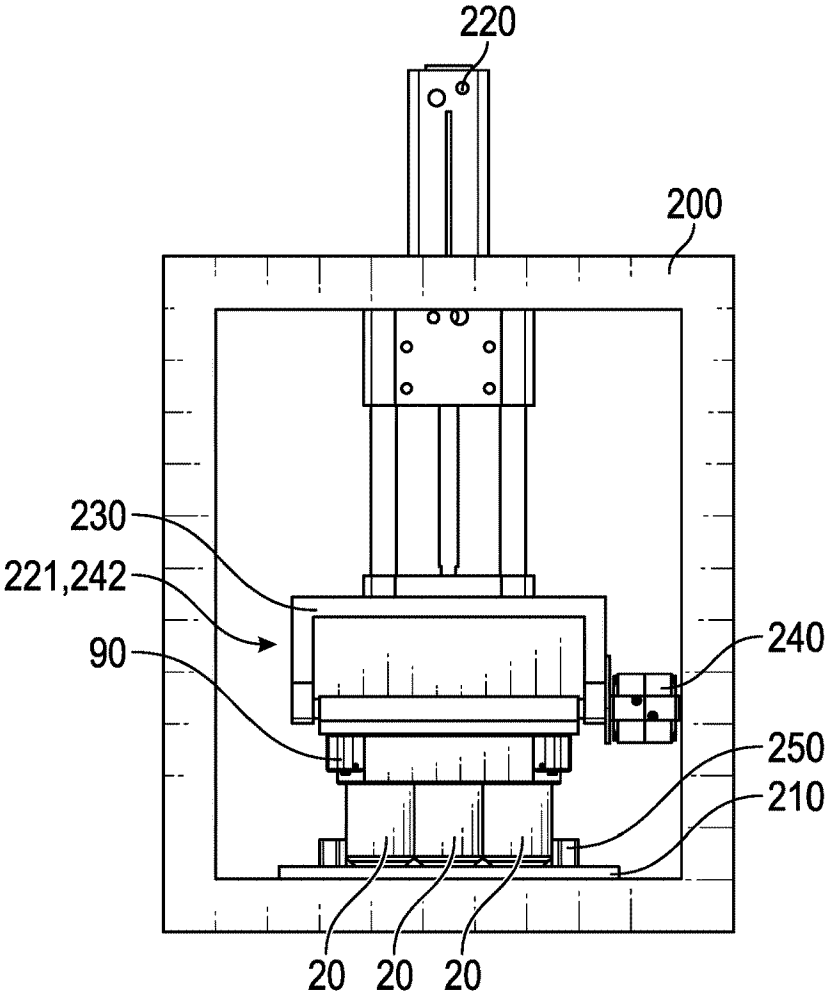
FIG. 13B is a front elevational view of FIG. 13A.
Figure 13A:
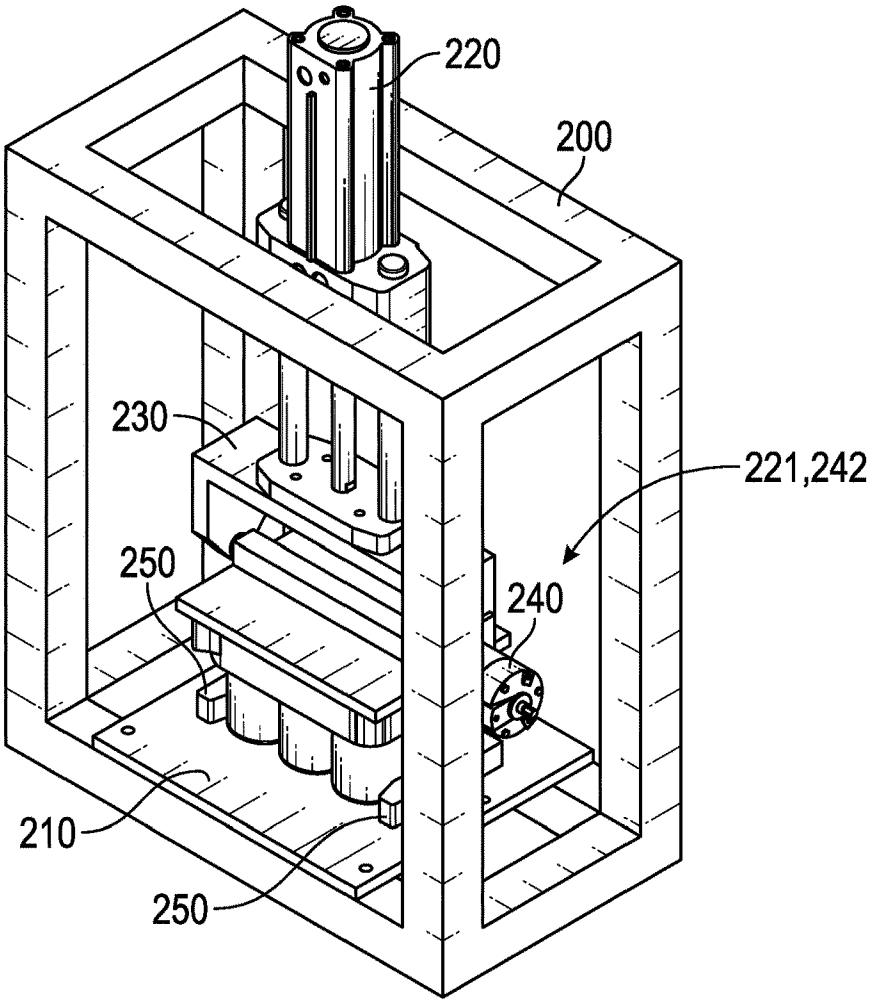
FIG. 13A is a top perspective view of the semi-automated machine of FIG. 12A, but with the application tool in the vertical and lowered position.
Figure 14B:
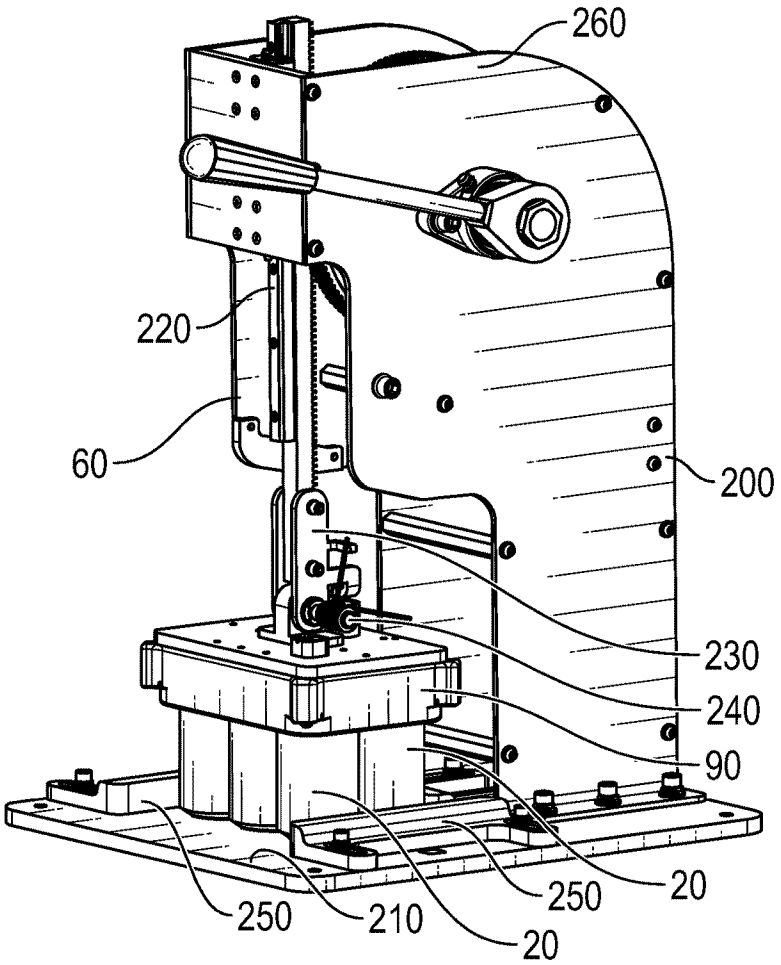
FIG. 14B is a perspective view of the semi-automated machine of FIG. 14A, but with the application tool in the vertical and lowered position.
Figure 14A:
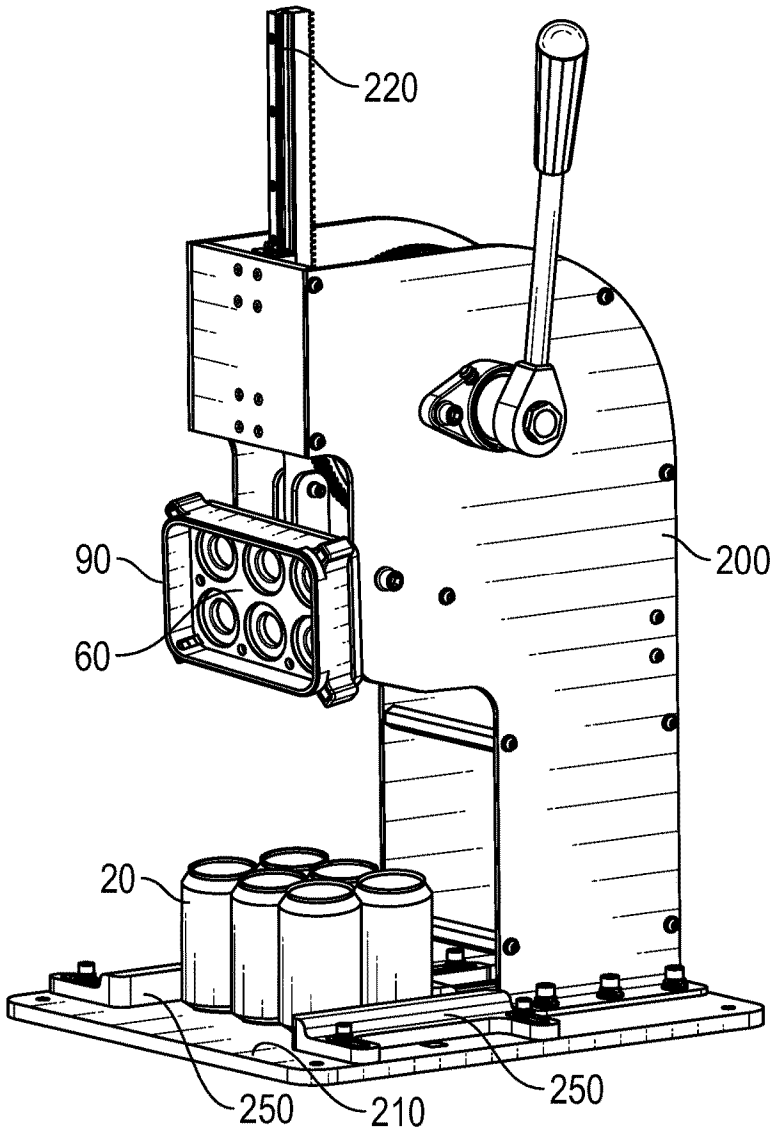
FIG. 14A is a perspective view of an alternate embodiment of the semi-automated machine for pressing the carrier onto a group of the containers utilizing the vertical actuator and the rotational actuator, illustrated with the application tool in a horizontal and raised position.

In some embodiments that feature a semi-automated system 10, a framework 200 (FIGS. 12A-15B) is included for mounting thereon a base surface 210 below a vertical actuator 220, which may include one or more linear actuators. The vertical actuator 220 has a trolley 230 that moves from a raised position 222 to a lowered position 221. The trolley includes a rotational actuator 240, such as a motor or a gearing arrangement that includes a motor, that holds the application tool 90 in either a horizontal position 241 wherein the platen 60 is substantially orthogonal to the base surface 210, or a vertical position 242 wherein the platen 40 of the application tool 90 is substantially parallel with the base surface 210. As such the application tool 90 is able to be moved between both the raised position 222 and the horizontal position 241 (FIGS. 12A, 12B, 14A) to facilitate loading of the carrier 40 into the application tool 90, to both the lowered position 221 and the vertical position 242 (FIGS. 13A, 13B, 14B) for applying the carrier 40 to the containers 20. The base surface 210 may further include at least one guide 250 for placing the containers 20 directly below the application tool 90 where needed based on the pattern of apertures 50 in the carrier 40. The embodiment illustrated in FIGS. 14A and 14B shows a manually-actuated vertical actuator 220, but could also be motor-assisted.

Such embodiments include manual switches or levers (not shown), power lines (not shown), safety curtains (not shown), and the like, as known in the art, to allow an operator to safely utilize the system 10 to apply the carriers 40 to groups of the containers 20 quickly and consistently. Such a system 10 can be quickly configured for a different type of carrier 40 by exchanging the application tool 90 associated with one carrier 40 to that associated with another of the carriers 40, such as, for example, changing from rectangular six-packs of the containers 20 (FIG. 2A) to the triangular 10-pack of containers as illustrated by the carrier 40 of FIG. 3.

A method of packaging two or more of the containers 20, therefore, comprises the following steps:

a) providing a carrier 40 as previously described;
b) providing the application tool 90 as previously described;
c) providing at least three of the carrier supports 70 fixed at corners 95 of the platen 60, as previously described;
d) inserting the carrier 40 into the application tool 90, the carrier supports 70 each retracting and then extending as the carrier 40 passes thereby, each carrier support 70 thereafter contacting at least a portion of a bottom side 42 of the carrier 40 to hold the carrier 40 onto the shelves 74 of the carrier supports 70;
e) positioning the containers 20 below the platen 60 and the carrier 40 with the chimes 27 of each container 20 in the common horizontal plane 30;
f) lowering the application tool 90 and platen 60 so that the carrier 40 is pushed onto the containers 20 uniformly, the tabs 50 of the carrier 40 deforming upwardly substantially simultaneously to pass the chimes 27 of the containers 20, each tab 50 abutting the lower edge 29 of the chime 27 of one of the containers 20 to hold the containers 20 together with the carrier 40; and g) withdrawing the application tool 90 from the carrier 40 and the containers 20, each carrier support 70 retracting and then extending as the carrier 40 passes the carrier support 70, thereby releasing the carrier 40 and the containers 20 from the application tool 90.

A semi-automated method of packaging two or more of the containers 20, comprises the following steps:

a) providing the carrier 40 having two or more of the apertures 50 each for receiving the chime 27 and neck 26 of one of the containers 20, each aperture 50 having the plurality of tabs 56 formed at the inside edge 55 thereof, each tab 56 configured for bending upward when contacting the chime 27 of one of the containers 20, each tab 56 having the length $L_T$ and the thickness $T_T$;

b) providing an application tool 90 having the top side 78 and the bottom side 92, the bottom side 92 forming the platen 60 that has the apertures 65 for pressing the carrier 40 down uniformly onto the containers 20, each aperture having the gap $D_1$ between the inside aperture 66 wall and the chime 27 of one of the containers 20; the application tool 90 having at least three side walls 100 that project downwardly from the bottom side 92 to form the skirt 101 open at a bottom end 102;

c) providing at least three of the carrier supports 70 fixed at the corners 95 of the platen 60, each carrier support 70 movable between the extended position 120 wherein the carrier support 70 includes the shelf 74 configured to contacting at least a portion of the bottom side 42 of the carrier 40 to maintain the carrier 40 in the flat configuration 80, and the retracted position 110 wherein the shelf 74 retracts away from the carrier 40, the spring 130 urging the carrier support 70 towards the extended position 120;

d) providing the framework 200 for mounting thereon the base surface 210 below the vertical actuator 220, the vertical actuator 220 having the trolley 230 that moves from the raised position 222 to the lowered position 221, the trolley 230 including the rotational actuator 240 that holds the application tool 90 in either the horizontal position 241 wherein the platen 60 is substantially orthogonal to the base surface 210, or the vertical position 242 wherein the platen 60 of the application tool 90 is parallel with the base surface 210;

e) with the application tool 90 in the raised position 222 and horizontal position 241, inserting the carrier 40 into the application tool 90, the carrier supports 70 each retracting and then extending as the carrier 40 passes thereby, each carrier support 70 thereafter contacting at least a portion of a bottom side 42 of the carrier 40 to hold the carrier 40 onto the shelves 74 of the carrier supports 70;

f) the rotational actuator moving the application tool 90 to the vertical position 242;

g) positioning the containers 20 below the platen 60 and the carrier 40 with the chimes 27 of each container 20 in the common horizontal plane 30;

h) the vertical actuator 220 lowering the application tool 90 and platen 60 so that the carrier 40 is pushed onto the containers 20 uniformly, the tabs 56 of the carrier 40 deforming upwardly substantially simultaneously to pass the chimes 27 of the containers 20, each tab 56 abutting the lower edge 29 of the chime 27 of one of the containers 20 to hold the containers 20 together with the carrier 40; and i) the vertical actuator 220 raising the application tool 90 away from the carrier 40 and the containers 20, each carrier support 70 retracting and then extending as the carrier 40 passes the carrier support 70, thereby releasing the carrier 40 and the containers 20 from the application tool 90.

Such methods might have steps interchanged when possible. For example, in the method immediately above, step g) might be performed before step e) or step f). As such, the lettered steps are merely suggestive and not intended to dictate a specific order of steps.

While a particular form of the invention has been illustrated and described, it will be apparent that various modifications can be made without departing from the spirit and scope of the invention. For example, each carrier support 70 may be disposed along a side wall of the platen 60 as opposed to the corners 95 of the platen 60. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms.

Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A system for packaging two or more containers of the type having a body, a neck, and a lid with a chime, the chimes of the containers all aligned in a horizontal plane, the containers packaged together with a carrier of the type having two or more apertures each for receiving the chime and the neck of one of the containers, each aperture having a plurality of tabs formed at an inside edge thereof, each tab configured for bending upward when contacting the chime of one of the containers, each tab having a length and a thickness, the system comprising:

an application tool having a top side and a bottom side, the bottom side forming a platen having apertures for pressing the carrier down uniformly onto the containers, each aperture having a gap between an inside aperture wall and the chime of one of the containers; the application tool having at least three side walls that project downwardly from the bottom side to form a skirt open at a bottom end; and at least three carrier supports fixed at corners of the platen, each carrier support movable between an extended position wherein the carrier support includes a shelf configured to contact at least a portion of a bottom side of the carrier to maintain the carrier in a flat configuration, and a retracted position wherein the shelf retracts away from the carrier, a spring urging the carrier support towards the extended position;

whereby with the carrier supported with the carrier supports, the platen is used to press the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers;

wherein a corner between a bottom surface of the platen and the inside aperture wall of each aperture of the platen is rounded;

wherein a corner of the shelf of each carrier support is rounded; and wherein the corner between the bottom surface of the platen and the inside aperture wall of each aperture of the platen includes a radius between 0.03125 inches and 0.09375 inches.

2. The system of claim 1 wherein the application tool, platen, and carrier are all substantially rectangular, and wherein the application tool includes at least four of the carrier supports, one at each corner of the application tool.

3. The system of claim 1 wherein the gap between the inside aperture wall of each aperture of the platen and the chime of one of the containers engaged with the aperture of the platen is between 0.030 inches and 0.050 inches.

4. The system of claim 1 wherein each carrier support includes a pivot pin, wherein the carrier support pivots between the extended position and the retracted position.

5. The system of claim 4 wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

6. The system of claim 5 further including a framework for mounting thereon a base surface below a vertical actuator, the vertical actuator having a trolley that moves from a raised position to a lowered position, the trolley including a rotational actuator that holds the application tool in either a horizontal position wherein the platen of the application tool is substantially orthogonal with the base surface, or a vertical position wherein the platen of the application tool is parallel with the base surface, the application tool being able to move between the raised and horizontal positions for facilitating loading one of the carriers into the application tool, and with the containers resting on the base surface a lowered and vertical position when applying the carrier to the containers.

7. The system of claim 6 wherein the base surface further includes at least one guide for facilitating position of the containers directly under the platen when the application tool is in the raised and vertical positions.

8. The system of claim 1 wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

9. The system of claim 1, wherein the shelf is parallel with the bottom surface of the platen when the shelf is in the extended position.

10. A system for packaging two or more containers of the type having a body, a neck, and a lid with a chime, the chimes of the containers all aligned in a horizontal plane, the containers packaged together with a carrier of the type having two or more apertures each for receiving the chime and the neck of one of the containers, each aperture having a plurality of tabs formed at an inside edge thereof, each tab configured for bending upward when contacting the chime of one of the containers, each tab having a length and a thickness, the system comprising:

an application tool having a top side and a bottom side, the bottom side forming a platen having apertures for pressing the carrier down uniformly onto the containers, each aperture having a gap between an inside aperture wall and the chime of one of the containers; the application tool having at least three side walls that project downwardly from the bottom side to form a skirt open at a bottom end; and at least three carrier supports fixed at corners of the platen, each carrier support movable between an extended position wherein the carrier support includes a shelf configured to contact at least a portion of a bottom side of the carrier to maintain the carrier in a flat configuration, and a retracted position wherein the shelf retracts away from the carrier, a spring urging the carrier support towards the extended position;

whereby with the carrier supported with the carrier supports, the platen is used to press the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers;

wherein a corner between a bottom surface of the platen and the inside aperture wall of each aperture of the platen is rounded; and wherein a corner of the shelf of each carrier support is rounded; and wherein the corner between the bottom surface of the platen and the inside aperture wall of each aperture of the platen includes a radius between 0.03125 inches and 0.09375 inches.

11. The system of claim 10 wherein the application tool, platen, and carrier are all substantially rectangular, and wherein the application tool includes at least four of the carrier supports, one at each corner of the application tool.

12. The system of claim 10 wherein the gap between the inside aperture wall of each aperture of the platen and the chime of one of the containers engaged with the aperture of the platen is between 0.030 inches and 0.050 inches.

13. The system of claim 10 wherein each carrier support includes a pivot pin, wherein the carrier support pivots between the extended position and the retracted position.

14. The system of claim 10 wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

15. A system for packaging two or more containers of the type having a body, a neck, and a lid with a chime, the chimes of the containers all aligned in a horizontal plane, the containers packaged together with a carrier of the type having two or more apertures each for receiving the chime and the neck of one of the containers, each aperture having a plurality of tabs formed at an inside edge thereof, each tab configured for bending upward when contacting the chime of one of the containers, each tab having a length and a thickness, the system comprising:

an application tool having a top side and a bottom side, the bottom side forming a platen having apertures for pressing the carrier down uniformly onto the containers, each aperture having a gap between an inside aperture wall and the chime of one of the containers; the application tool having at least three side walls that project downwardly from the bottom side to form a skirt open at a bottom end;

at least three carrier supports fixed at corners of the platen, each carrier support movable between an extended position wherein the carrier support includes a shelf configured to contact at least a portion of a bottom side of the carrier to maintain the carrier in a flat configuration, and a retracted position wherein the shelf retracts away from the carrier, a spring urging the carrier support towards the extended position; and a framework for mounting thereon a base surface below a vertical actuator, the vertical actuator having a trolley that moves from a raised position to a lowered position, the trolley including a rotational actuator that holds the application tool in either a horizontal position wherein the platen of the application tool is substantially orthogonal with the base surface, or a vertical position wherein the platen of the application tool is parallel with the base surface, the application tool being able to move between the raised and horizontal positions for facilitating loading one of the carriers into the application tool, and with the containers resting on the base surface a lowered and vertical position when applying the carrier to the containers;

whereby with the carrier supported with the carrier supports, the platen is used to press the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers;

wherein a corner between a bottom surface of the platen and the inside aperture wall of each aperture of the platen is rounded; and wherein a corner of the shelf of each carrier support is rounded.

16. The system of claim 15 wherein the application tool, platen, and carrier are all substantially rectangular, and wherein the application tool includes at least four of the carrier supports, one at each corner of the application tool.

17. The system of claim 15 wherein the corner between the bottom surface of the platen and the inside aperture wall of each aperture of the platen includes a radius between 0.03125 inches and 0.09375 inches.

18. The system of claim 15 wherein the gap between the inside aperture wall of each aperture of the platen and the chime of one of the containers engaged with the aperture of the platen is between 0.030 inches and 0.050 inches.

19. The system of claim 15 wherein:

each carrier support includes a pivot pin, wherein the carrier support pivots between the extended position and the retracted position; and a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

20. A system for packaging two or more containers of the type having a body, a neck, and a lid with a chime, the chimes of the containers all aligned in a horizontal plane, the containers packaged together with a carrier of the type having two or more apertures each for receiving the chime and the neck of one of the containers, each aperture having a plurality of tabs formed at an inside edge thereof, each tab configured for bending upward when contacting the chime of one of the containers, each tab having a length and a thickness, the system comprising:

an application tool having a top side and a bottom side, the bottom side forming a platen having apertures for pressing the carrier down uniformly onto the containers, each aperture having a gap between an inside aperture wall and the chime of one of the containers; the application tool having at least three side walls that project downwardly from the bottom side to form a skirt open at a bottom end; and at least three carrier supports fixed at corners of the platen, each carrier support movable between an extended position wherein the carrier support includes a shelf configured to contact at least a portion of a bottom side of the carrier to maintain the carrier in a flat configuration, and a retracted position wherein the shelf retracts away from the carrier, a spring urging the carrier support towards the extended position;

whereby with the carrier supported with the carrier supports, the platen is used to press the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers;

wherein a corner between a bottom surface of the platen and the inside aperture wall of each aperture of the platen is rounded;

wherein a corner of the shelf of each carrier support is rounded; and wherein the gap between the inside aperture wall of each aperture of the platen and the chime of one of the containers engaged with the aperture of the platen is between 0.030 inches and 0.050 inches.

21. The system of claim 20 wherein the application tool, platen, and carrier are all substantially rectangular, and wherein the application tool includes at least four of the carrier supports, one at each corner of the application tool.

22. The system of claim 20 wherein the corner between the bottom surface of the platen and the inside aperture wall of each aperture of the platen includes a radius between 0.03125 inches and 0.09375 inches.

23. The system of claim 20 wherein each carrier support includes a pivot pin, wherein the carrier support pivots between the extended position and the retracted position.

24. The system of claim 20 wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

25. The system of claim 24 wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

26. The system of claim 25 further including a framework for mounting thereon a base surface below a vertical actuator, the vertical actuator having a trolley that moves from a raised position to a lowered position, the trolley including a rotational actuator that holds the application tool in either a horizontal position wherein the platen of the application tool is substantially orthogonal with the base surface, or a vertical position wherein the platen of the application tool is parallel with the base surface, the application tool being able to move between the raised and horizontal positions for facilitating loading one of the carriers into the application tool, and with the containers resting on the base surface a lowered and vertical position when applying the carrier to the containers.

27. The system of claim 26 wherein the base surface further includes at least one guide for facilitating position of the containers directly under the platen when the application tool is in the raised and vertical positions.

28. The system of claim 20, wherein the shelf is parallel with the bottom surface of the platen when the shelf is in the extended position.

29. A system for packaging two or more containers of the type having a body, a neck, and a lid with a chime, the chimes of the containers all aligned in a horizontal plane, the containers packaged together with a carrier of the type having two or more apertures each for receiving the chime and the neck of one of the containers, each aperture having a plurality of tabs formed at an inside edge thereof, each tab configured for bending upward when contacting the chime of one of the containers, each tab having a length and a thickness, the system comprising:

an application tool having a top side and a bottom side, the bottom side forming a platen having apertures for pressing the carrier down uniformly onto the containers, each aperture having a gap between an inside aperture wall and the chime of one of the containers; the application tool having at least three side walls that project downwardly from the bottom side to form a skirt open at a bottom end;

at least three carrier supports fixed at corners of the platen, each carrier support movable between an extended position wherein the carrier support includes a shelf configured to contact at least a portion of a bottom side of the carrier to maintain the carrier in a flat configuration, and a retracted position wherein the shelf retracts away from the carrier, a spring urging the carrier support towards the extended position; and a framework for mounting thereon a base surface below a vertical actuator, the vertical actuator having a trolley that moves from a raised position to a lowered position, the trolley including a rotational actuator that holds the application tool in either a horizontal position wherein the platen of the application tool is substantially orthogonal with the base surface, or a vertical position wherein the platen of the application tool is parallel with the base surface, the application tool being able to move between the raised and horizontal positions for facilitating loading one of the carriers into the application tool, and with the containers resting on the base surface a lowered and vertical position when applying the carrier to the containers;

whereby with the carrier supported with the carrier supports, the platen is used to press the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers;

wherein a corner between a bottom surface of the platen and the inside aperture wall of each aperture of the platen is rounded;

wherein a corner of the shelf of each carrier support is rounded;

wherein each carrier support includes a pivot pin, wherein the carrier support pivots between the extended position and the retracted position; and wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

30. The system of claim 29 wherein the application tool, platen, and carrier are all substantially rectangular, and wherein the application tool includes at least four of the carrier supports, one at each corner of the application tool.

31. The system of claim 29 wherein the corner between the bottom surface of the platen and the inside aperture wall of each aperture of the platen includes a radius between 0.03125 inches and 0.09375 inches.

32. The system of claim 29 wherein the gap between the inside aperture wall of each aperture of the platen and the chime of one of the containers engaged with the aperture of the platen is between 0.030 inches and 0.050 inches.

33. The system of claim 29 wherein a top side of the shelf of each carrier support is tapered, such that when inserting a carrier onto the platen, each carrier support is pressed by the carrier into the retracted position until the carrier passes the shelf, thereafter each carrier support moving back to the extended position to capture the carrier against the platen.

34. The system of claim 29 wherein the base surface further includes at least one guide for facilitating position of the containers directly under the platen when the application tool is in the raised and vertical positions.

35. The system of claim 29, wherein the shelf is parallel with the bottom surface of the platen when the shelf is in the extended position.

* * * * *